US006295080B1

(12) United States Patent
Deguchi et al.

(10) Patent No.: US 6,295,080 B1
(45) **Date of Patent: *Sep. 25, 2001**

(54) IMAGE RECORDING APPARATUS WITH PRINT HEAD HAVING PLURAL LIGHT EMITTING ELEMENTS

(75) Inventors: Takashi Deguchi; Tuyosi Hattori; Toru Kawabe, all of Hino (JP)

(73) Assignee: Konica Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/040,492

(22) Filed: Mar. 18, 1998

(30) Foreign Application Priority Data

Mar. 24, 1997 (JP) ..... 9-069408

(51) Int. Cl.[7] ..... B41J 2/435
(52) U.S. Cl. ..... 347/262; 347/122; 347/121
(58) Field of Search ..... 347/257, 238, 347/262, 236, 122, 121, 130, 155

(56) References Cited

U.S. PATENT DOCUMENTS 4,897,672 * 1/1990 Horiuchi et al. ..... 347/236
4,949,099 * 8/1990 Shimizu et al. ..... 347/238
5,451,988 * 9/1995 Ono ..... 347/185
5,570,192 * 10/1996 Terauchi et al. ..... 356/307
5,812,176 * 9/1998 Kawabe et al. ..... 347/240
5,923,355 * 7/1999 Fujita et al. ..... 347/240

FOREIGN PATENT DOCUMENTS

0158962 A2 10/1985 (EP) .
0410695 A2 1/1991 (EP) .

OTHER PUBLICATIONS

Patent Abstracts of Japan, vol. 017, No. 649 (E–1468), Dec. 2, 1993 & JP 05 211587 A (Kyocera Corp.), Aug. 20, 1993.
Patent Abstracts of Japan, vol. 097, No. 009, Sep. 30, 1997 & JP 09 116700 A (Canon Inc.), May 2, 1997.
Patent Abstracts of Japan, vol. 015, No. 506. (E–1148), Dec. 20, 1991 & JP 03 220972 S (Matsushita Graphic Commun System Inc.), Sep. 30, 1991.

* cited by examiner

*Primary Examiner*—N. Le
*Assistant Examiner*—Lamson D. Nguyen
(74) *Attorney, Agent, or Firm*—Frishauf, Holtz, Goodman, Langer & Chick, P.C.

(57) ABSTRACT

An image recording apparatus is provided with a recording head in which a plurality of light emitting sections are aligned along a single dotted line or plural dotted lines, and a shifting device for shifting photosensitive material relatively to the recording head so that an image is recorded on the photosensitive material with exposure light emitted by the light emitting sections while the photosensitive material is shifted relatively to the recording head. The recording head is controlled to conduct preliminary light emission to let the light emitting sections emit light before the image recording on the photosensitive material is started.

19 Claims, 3 Drawing Sheets

IMAGE RECORDING APPARATUS WITH PRINT HEAD HAVING PLURAL LIGHT EMITTING ELEMENTS

BACKGROUND OF THE INVENTION

The present invention relates to an image recording apparatus comprising a recording head in which a plurality of light-emitting sections are aligned along a single dotted line or plural dotted lines and the image recording apparatus conducts image recording on a photosensitive material with exposure light emitted by the light-emitting section while shifting the photosensitive material relatively to the recording head.

When image recording is conducted on a photosensitive material by an image recording apparatus comprising a recording head in which a plurality of light-emitting sections are aligned along a single dotted line or plural dotted lines, in such a manner that the photosensitive material is exposed with exposure light emitted by the light-emitting section while being shifted relatively to the recording head, the developed photosensitive material may get a desired even image density, however, there may be problems from time to time that the image density of the developed photosensitive material may become higher or lower.

The above phenomenon was notable when the processing amount was too small. Accordingly, the problems were supposed to be caused by malfunction of the developing process or by malfunction of the exposure control system, and the true causes were not known. However, as a result of trial and error, the inventor learned that the cause of the problems may be that the light emission amount of the light emitting section of the recording head in the above image recording apparatus fluctuates depending on its working history.

SUMMARY OF THE INVENTION

The objective of the present invention is to solve the above problems and to avoid density fluctuation in a developed photosensitive material due to light emission amount fluctuation of the light emitting section of the recording head depending on its working history in the above image recording apparatus.

The cause of the light emission amount fluctuation of the light emitting section of the recording head was not sufficiently investigated. However, the following phenomenon may be considered. That is, in the case that a vacuum fluorescent print head (VFPH) is used as the recording head, electrons are adapted to fly in a chamber on a vacuum condition. However, gas remains in the chamber and the gas adhere on a fluorescent member of the light emitting section. Initially, when electrons hit to the fluorescent member, light emission amount gradually increases to a stable light emission amount. Further, in the case that an LED array is used as the recording head, its working temperature increases due to self-heat generation to a stable temperature, and a light emission amount may decreases as the temperature increases.

The inventor learned that by conducting preliminary light emission the influence of the above working history may be reduced. As a result, the inventor conceived the present invention. That is, the above problems may solved by the structure described in each of the following items.

Item 1. In an image recording apparatus comprising a recording head in which a plurality of light-emitting sections are aligned along a single dotted line or plural dotted lines and the image recording apparatus conducts image recording on a photosensitive material with exposure light emitted by the light-emitting section while shifting the photosensitive material relatively to the recording head, the image recording apparatus is characterized in that before the image recording on the photosensitive material is started after the power source for the apparatus is turn ed on, preliminary light emission to let the light-emitting sections of the recording head emit light is conducted.

With the structure described in Item 1, the density fluctuation of the developed photosensitive material due to the light emission amount fluctuation of the light emitting sections of the recording head depending on its working history can be avoided.

Incidentally, the term "before the image recording on the photosensitive material is started after the power source for the apparatus is turned on" means the time period before the image recording to form an image for actual use on the photosensitive material is conducted after the power source for the apparatus is turned on. A setup image recording or an image recording for a reference image is excepted from the consideration on this period. Needless to say, after the preliminary light emission, it may be preferable to prepare such a setup image recording and an image recording for a reference image.

Usually, an automatic processing machine is used in such a way that the power source is turned on in the morning, kept on during the day time, and turned off in the evening. In this case, the preliminary light emission can be conducted with a simple control right after the power source is turned on. Since the preliminary light emission does not interfere with actual image recording, it may be preferable. In the case of timer operation, it goes without saying that power source ON by the timer means "the power supply ON".

Item 2. The image recording apparatus described in Item 1, wherein the light emitting period of the preliminary light emission by the light emitting section is 30 minutes or less.

With the structure described in Item 2, the density fluctuation of the developed photosensitive material due to the light emission amount fluctuation of the light emitting sections of the recording head depending on its working history can be avoided. In addition, if emission time is 10 minutes or less, fluctuation of density can be prevented. In addition, it is preferable that using time of the machine can be shortened.

Item 3. In an image recording apparatus comprising a recording head in which a plurality of light-emitting sections are aligned along a single dotted line or plural dotted lines and the image recording apparatus conducts image recording on a photosensitive material with exposure light emitted by the light-emitting section while shifting the photosensitive material relatively to the recording head, the image recording apparatus is characterized in that preliminary light emission to let the light-emitting sections of the recording head emit light is conducted for every predetermined time.

With the structure described in Item 3, the density fluctuation of the developed photosensitive material due to the light emission amount fluctuation of the light emitting sections of the recording head depending on its working history can be avoided.

Incidentally, the predetermined time is preferable to be 24 hours or less. In this case, the light emission period of the preliminary light emission may be 30 minutes or less. However, it may be not limited to such a period. For example, it may be permissible to conduct the preliminary light emission for 30 minutes for every 24 hours or for 10 minutes for every 8 hours. In addition, if aforesaid predetermined times are slightly increased or decreased, the effects of the present invention can still be obtained. Therefore, to conduct the procedure every 24 hours may be repeated within several hours every morning.

Item 4. The image recording apparatus described in Item 3, wherein the predetermined time is not longer than 30 minutes.

With the structure described in Item 4, the density fluctuation of the developed photosensitive material due to the light emission amount fluctuation of the light emitting sections of the recording head depending on its working history can be avoided. In addition, if the predetermined time is 10 minutes or less, fluctuation of density can be prevented and it is preferable that using time of the machine can be reduced.

Item 5. In an image recording apparatus comprising a recording head in which a plurality of light-emitting sections are aligned along a single dotted line or plural dotted lines and the image recording apparatus conducts image recording on a photosensitive material with exposure light emitted by the light-emitting section while shifting the photosensitive material relatively to the recording head, the image recording apparatus is characterized in that the recording head is controlled to conduct preliminary light emission to let the light emitting sections emit light for every predetermined timing.

Item 6. The image recording apparatus described in Item 5, wherein the preliminary light emission is conducted for each processing order.

With the structure described in Items 5 and 6, by conducting the preliminary light emission for each printing order, the light emission amount can be made stable without delaying the image outputting time. Herein, the term "every timing" means every output for a single print, every processing order or every predetermined number of prints. Further, "each processing order" means a single piece of roll film with 24 frames or 36 frames in the case of a negative film or a single sheet of print when one customer requests a single sheet of photograph for identification.

Item 7. The image recording apparatus described in Item 6, wherein the preliminary light emission is conducted right before starting recording an image on a photosensitive material.

With the structure described in Item 7, the density fluctuation of the developed photosensitive material due to the light emission amount fluctuation of the light emitting sections of the recording head depending on its working history can be avoided.

Incidentally, the term "right before starting recording an image on the photosensitive material" means 5 minutes before starting recording an image. It may be preferable that the preliminary light emission is conducted 1 minute or more preferably 30 seconds before starting recording an image.

Item 8. The image recording apparatus described in Item 7, wherein the preliminary light emission for each printing order is not longer than 60 seconds.

Item 9. The image recording apparatus described in either one of Items 1 to 8, wherein the intensity of light emitted for the preliminary light emission is greater than that emitted for recording an image on the photosensitive material.

With the structure described in Item 9, the density fluctuation of the developed photosensitive material due to the light emission amount fluctuation of the light emitting sections of the recording head depending on its working history can be avoided. By conducting the preliminary light emission with the intensity of light greater than that emitted for recording an image on the photosensitive material, the preliminary light emission can be conducted stably in a short time. As a method of raising the intensity of light, to raise a set voltage, or to drive all elements simultaneously may be used so as to obtain the intensity of light greater than that emitted for recording an image on the photosensitive material.

Item 10. The image recording apparatus described in either one of Items 1 to 9, wherein the light emitting time period of the light emitting sections for the preliminary light emission is longer than the average of the light emitting time period of the light emitting sections for the image recording.

With the structure described in Item 10, the density fluctuation of the developed photosensitive material due to the light emission amount fluctuation of the light emitting sections of the recording head depending on its working history can be avoided.

Item 11. The image recording apparatus described in either one of Items 1 to 10, wherein correction data for the intensity of emitted light among the light emitting sections are obtained during the preliminary light emission or after the preliminary light emission.

With the structure described in Item 11, the density fluctuation of the developed photosensitive material due to the light emission amount fluctuation of the light emitting sections of the recording head depending on its working history can be avoided, and also the correction data for the intensity of emitted light among the light emitting sections can be obtained, thereby time loss for conducting both operations separately can be saved.

As a method of obtaining the correction data, a method of measuring densities on an image recorded on the photosensitive material by a measuring device such as a scanner or a densitometer or a method of measuring directly the luminance of light by a sensor may be used. Especially, the method of measuring directly the luminance of light by a sensor may be preferable, because the correction data can be obtained quickly and simply. In the case of the method of measuring directly the luminance of light by a sensor, it may be preferable to prepare the reference data in advance and to obtain the correction data from the deviations for the reference data.

As the correction data, the data to correct the difference in light emission amount among the light emitting sections of the recording head or the LUT data to correct the light emitting characteristics of the recording head may be listed.

Item 12. The image recording apparatus described in either one of Items 1 to 11, wherein the recording head is subject to aging process.

With the structure described in Item 12, the density fluctuation of the developed photosensitive material due to the light emission amount fluctuation of the light emitting sections of the recording head depending on its working history can be avoided.

The term "the recording head is subject to aging process" means that the recording head is treated so as to stabilize its characteristics, for example, in the case of an electrically-driven recording head, the recording head is held for 100 hours under the normal temperature and the normal pressure on the condition that the recording head is applied with the electricity, or is applied with the electricity under a high temperature.

Item 13. The image recording apparatus described in either one of Items 1 to 12, wherein the recording head is a vacuum fluorescent print head.

With the structure described in Item 13, the density fluctuation of the developed photosensitive material due to the light emission amount fluctuation of the light emitting sections of the vacuum fluorescent print head depending on its working history can be avoided.

Item 14. The image recording apparatus described in Item 13, wherein when the vacuum fluorescent print head dose not conduct the image recording, at least one of cathode voltage, grid voltage and anode voltage is turned off.

Item 15. The image recording apparatus described in Item 13, wherein when the vacuum fluorescent print head dose not conduct the image recording, all of cathode voltage, grid voltage and anode voltage are turned off.

With the structure describe in Items 14 and 15, by turning off a voltage to activate or scatter the remaining gas in the vicinity of the phosphor such as cathode voltage, grid voltage or anode voltage when the vacuum fluorescent print head dose not conduct the image recording, the remaining gas can be prevented from adhering the phosphor so that the light emission amount can be made stable.

Item 16. The image recording apparatus described in either one of Items 1 to 12, wherein the recording head is a LED array.

With the structure described in Item 16, the density fluctuation of the developed photosensitive material due to the light emission amount fluctuation of the light emitting sections of the LED array depending on its working history can be avoided.

[Explanation of technical terms]

As a plurality of light emitting portions arranged in one row of or a plurality of rows of dotted lines, the following configurations are preferable: as shown by FIG. 1(*a*), a plurality of light emitting portions are arranged in one line-like of dotted row; as shown by in FIG. 1(*b*), a plurality of light emitting portions are arranged in two line-like dotted rows; as shown by in FIG. 1(*c*), a plurality of light emitting portions are arranged in three line-like dotted rows, or similar arrangement. In this connection, in FIGS. 1(*b*) and 1(*c*), the light emitting portions are arranged in different positions with respect to the arrangement direction, however, a plurality of rows of the light emitting portions may be arranged in the same position.

Further, as the light emitting section of "a recording head in which a plurality of light-emitting sections are aligned along a single dotted line or plural dotted lines", a LED light emitting element of an LED array, a fluorescent light emitting element of a vacuum fluorescent print head (VFPH), a respective shutter of PLZT shutter array placed in front of a light source, a respective liquid crystal shutter of a liquid crystal array placed in front of a light source, and the other end of optical fiber whose one end is connected to a respective light emitting source, may be used.

As a photosensitive material, a silver halide photographic light sensitive material may be preferable. However, the photosensitive material is not limited to this, a photoreceptor for an electrophotography or a light sensitive resin such as a photopolymer may be used. As the silver halide photographic light sensitive material, a monochromatic photographic light sensitive material or a color photographic light sensitive material may be used. Further, a photographic paper or a photographic film may be used. Still further, a photographic light sensitive material for printing, a photographic light sensitive material for photographing or a photographic light sensitive material for copying may be used.

In the present invention, the preliminary light emission may be conducted by a part of the recording head. For example, by conducting the preliminary light emission separately by the light emitting section having odd numbers and by the light emitting section having even numbers in the recording head, an excessive temperature raise can be avoided and the light emitting characteristics can be effectively stabilized.

As the recording head capable of obtaining the effect of the present invention, an LED array, or a fluorescent print head (VFPH) may be used. Especially, with the fluorescent print head (VFPH), a remarkable effect can be obtained.

DETAILED DESCRIPTION OF THE PREFERRED EMBODIMENTS

An example according to the present invention will be described below, however, the present invention is not limited to the example. Further, in the example, although conclusive expressions are used for the terminology, these show a preferable example of the present invention, and meanings of terminology or technological scope of the present invention are not limited to them.

Embodiment

Figure 2:
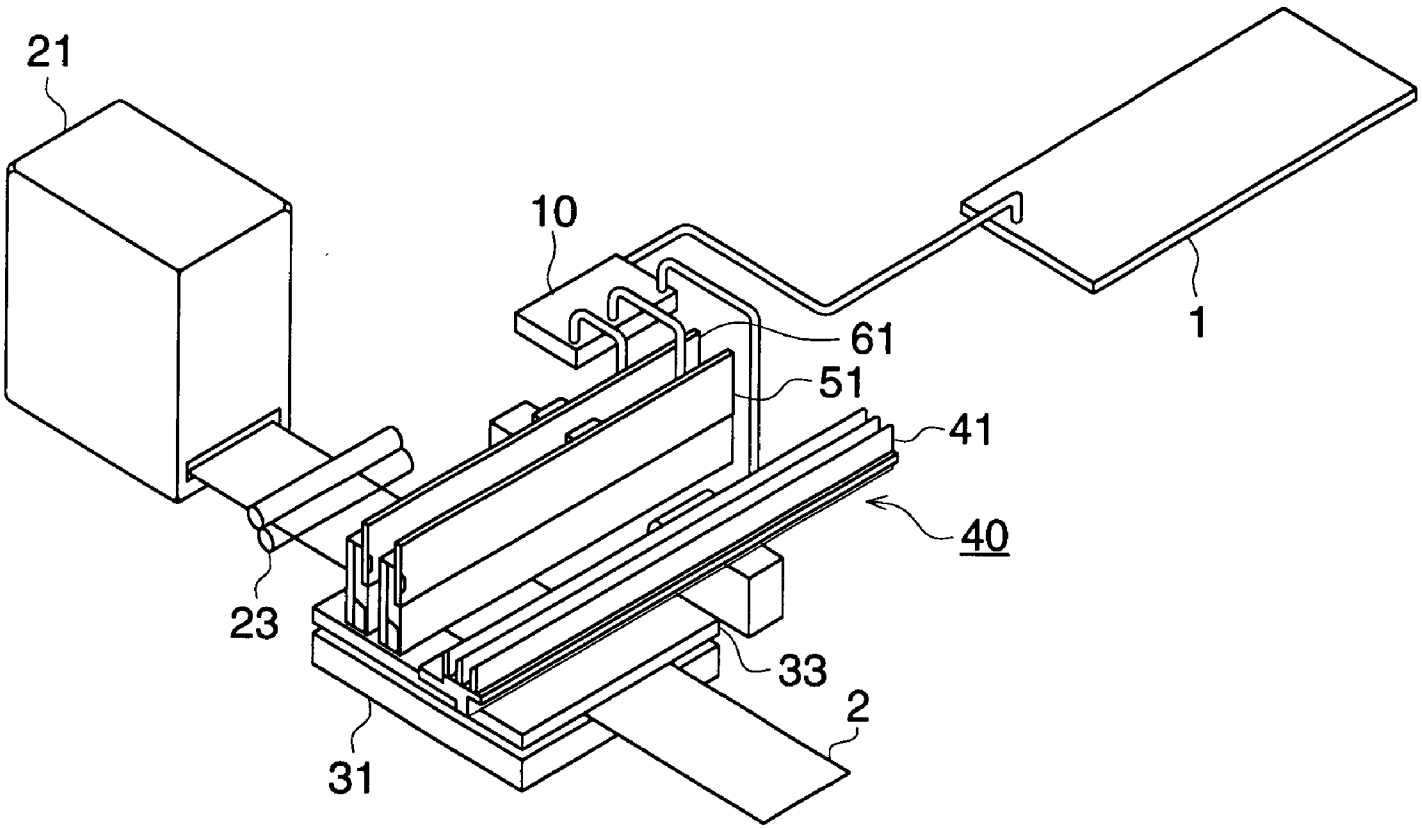
FIG. 2 is a general perspective view of an image recording apparatus of the present invention.

The image recording apparatus in the present embodiment comprises an exposure head, in which a plurality of light emitting portions are arranged in one row of or a plurality of rows of dotted lines. The image recording apparatus records an image by exposing with light emitted from the recording head a photographic paper which is a silver halide color photographic light sensitive material containing silver chloride of 90 mol% or more in the composition of the silver halide. Referring to FIG. 2, which is a general perspective view of the image recording apparatus of the present example, the image recording apparatus will be described below.

As a photographic paper 2 exposed in the image recording apparatus, a color photographic paper having light sensitive layers sensitive for primary color light of R, G and B such as a color photographic paper having a red sensitive layer for coloring in cyan, a green sensitive layer for coloring in magenta and a blue sensitive layer for coloring in yellow may be used preferably, and a color negative photographic paper or a color positive photographic paper also may be used preferably.

An image processing control circuit 1 converts inputted color image data into output image data for each primary color, and sends it to a signal processing section 10. The signal processing section 10 has therein a signal processing circuit for each primary color. Each primary color signal processing circuit of the signal processing section 10 is connected to a corresponding exposure head 41, 51, and 61 conducting exposure for a corresponding primary color. Each signal processing circuit of the signal processing section 10 corrects the inputted output image data according to correction data, generates a driving control signal from corrected output image data, and sends the signal to the exposure heads 41, 51, and 61. In the exposure heads 41, 51 and 61, each light emitting section emits light according to the sent driving control signal.

In the image recording apparatus, a magazine 21 is set in a predetermined direction and position, and accommodates a roll-like photographic paper 2 therein. A feeding roller pair 23 conveys the photographic paper pulled out of the magazine 21, so as to be pulled out or returned. An exposure unit 40 comprising fixed exposure heads 41, 51, and 61 exposes the photographic paper conveyed by the feeding roller pair 23, thereby conducting image recording. On the basis of the information of a counter to count driving pulses of a driving step motor of the feeding roller pair 23, the image processing control circuit 1 conducts the image recording for the image data corresponding to a single image line.

A transparent glass plate 33 closely contacting with the photographic paper, is provided between the exposure heads 41, 51, 61 and photographic paper 2. The lower end surface of the transparent glass plate 33 is the exposure image forming surface of each of exposure heads 41, 51, and 61, and the photographic paper 2 is positioned on the exposure image forming surface by the transparent glass plate 33. The image recording apparatus has a pressing member 31 to position the photosensitive surface of the photographic paper 2 on the lower end surface of the transparent glass plate 33 when the photographic paper 2 is exposed. When the photographic paper 2 is exposed, the pressing member 31 presses the photographic paper 2 onto the transparent glass plate 33, and in other cases, the pressing member 31 is separated from the transparent glass plate 33.

In this connection, the exposure head 41 is the exposure head to expose the light of R, the exposure head 51 is the exposure head to expose the light of G, and the exposure head 61 is the exposure head to expose the light of B.

Figure 1:
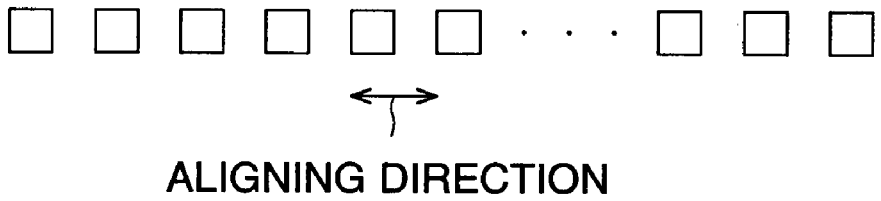
FIGS. 1(*a*)–(*c*) are views showing examples of a plurality of light emitting portions arranged in one row or a plurality of rows of dotted lines.
Figure 1:
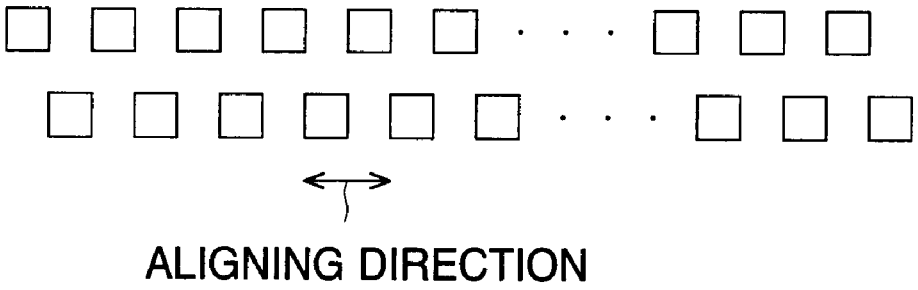
Figure 1:
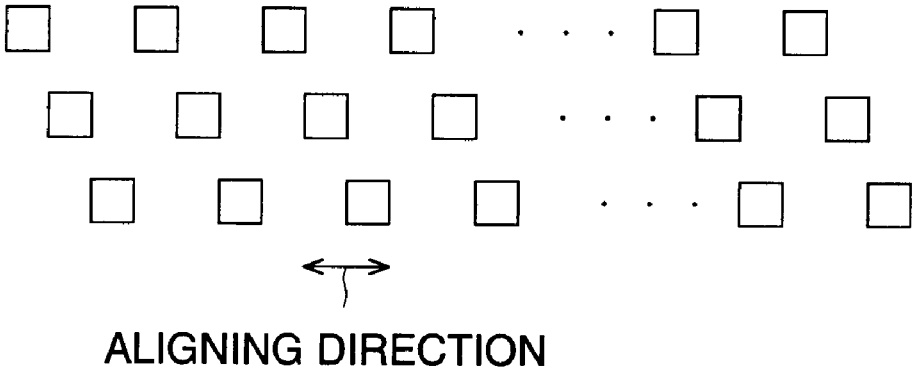

Exposure heads 51 and 61 are respectively fluorescent display tube type vacuum fluorescent print heads (VFPH) which have a phosphor illuminating a blue-green beam. As shown in FIG. 1(*b*), they have 2560 pieces of 300 dpi fluorescent illuminant elements of zinc oxide phosphor (ZnO:Zn) which is a luminescent section capable of illuminating in a double rows of equally spaced dots. On each fluorescent illuminant element, a Selfoc lens array, which is an aggregate of lenses having a lens function, is located at the prescribed position on the front side thereof. On transparent glass plate 33 surface which faces exposure head 61, a blue filter (LEE filter 181 marketed by Konica Color Material Co., Ltd.) is provided for exposing B light. On transparent glass plate 33 surface which faces exposure head 51, a yellow filter (LEE filter HT015 marketed by Konica Color Material Co., Ltd.) is provided for exposing G light.

With regard to the double rows of equally spaced dots, each row may be illuminated alternately.

Figure 3:
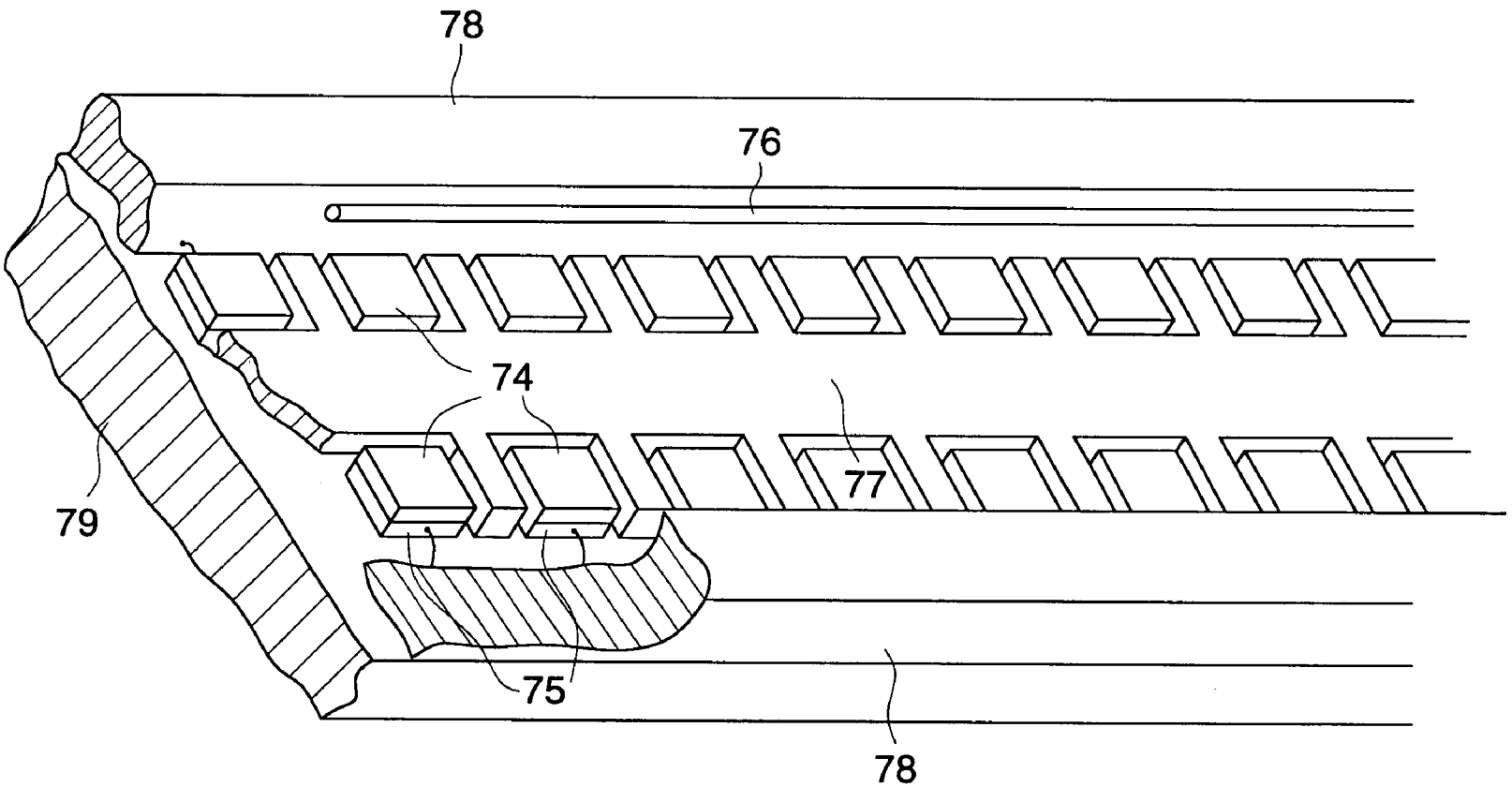
FIG. 3 is a general perspective view showing an inside of VFPH used in the present invention.

A mechanism in which a illuminating section on aforesaid vacuum fluorescent print head is actuated will be simply explained based on FIG. 3 which is a schematic perspective view inside the vacuum fluorescent print head. Each illuminating section 74 on aforesaid vacuum fluorescent print head is a phosphor element which illuminates when an electron beam is collided thereon. Below aforesaid illuminating section 74, anode electrode 75, which is a transparent electrode, is superposed. Above illuminating section 74, wire 76, which is a cathode electrode common to the whole illuminating section is bridged. Around each illuminating section 74, grid electrode 77 which is common to the whole illuminating section is provided in such a manner not to contact anode electrode 75. Each anode electrode is respectively connected to circuit 78 for recording head. Aforesaid anode electrode 75, grid electrode 77 and circuit 78 for recording head are located on transparent plate 79. Aforesaid anode electrode 75, all illuminating sections 74, wire 76, which is a cathode electrode and grid electrode 77 are tightly enclosed in vacuum space. On wire 76, which is a cathode electrode, 5.2 V A.C. voltage at which frequency is 100 kHz and Duty ratio is 50% is impressed. On grid electrode 77, 40V positive voltage is impressed. On anode electrode 75 controlled to illuminate, 24 V positive voltage is impressed. On anode electrode 75 controlled to not illuminate, 5 V positive voltage is impressed.

Then, an electron beam which started from wire 76 tries to reach the grid electrode and the anode electrode controlled to illuminate. An electron beam which started from wire 76 tries to reach the anode electrode controlled to illuminate touches illuminating section 74 which is a phosphor. Then, illuminating section 74 which is a phosphor illuminates. The illuminated material transmits anode electrode 75, which is a transparent electrode, and transparent plate 79, and then, image-formed on a light-sensitive material by means of a Selfoc lens array.

Suppose that VA represents a voltage impressed to anode electrode controlled so that illuminating and VG represents a voltage impressed to a grid electrode, VA/VG becomes 0.6. Since aforesaid value is less than 0.9, inter-effect of illuminating sections adjoining each other can be reduced, and since it is larger than 0.3, sufficient illuminating amount can be obtained.

Exposure head 41 has 640 pieces of 300 dpi illuminating section which are LED illuminating elements whose peak wavelength is 665 nm. Aforesaid illuminating sections are located in a form of one row in a form of dot line having equivalent intervals. A Selfoc lens, which is an aggregate of lenses having lens function on each LED illuminating element is located at a prescribed position in front of aforesaid illuminating elements.

Due to setting in advance, image processing and control circuit 1 can illuminate all illuminating sections on the recording head at a certain time set in advance and at an illuminating intensity set in advance (impressed voltage) immediately before recording an image set in advance or every certain time interval. By setting as above, image processing and control circuit 1 functions as a control means which conducts preliminary illuminating which illuminates the illuminating sections on the above-mentioned recording head before starting image recording onto the above-mentioned light-sensitive material after charging the apparatus power supply or a control means which conducts preliminary illuminating which illuminates the illuminating sections on the above-mentioned recording head at every prescribed times.

EXAMPLES

Only exposure head 51 (exposure head for G use) was operated so that a photographic image in which a face of a person was the main object and the background was a gradation from white to black was continuously outputted for 3 days. After continuous outputting, wedge images were outputted. After that, difference of density at a position corresponding to a portion where white background had been recorded by exposure head 51 and density at a position corresponding to a portion where black background had been recorded by exposure head 51 was observed, provided that the cathode voltage, the grid voltage and the anode voltage were turned OFF except when images were outputted.

Experiment Number 1-1

With regard to each of image recording, preliminary illuminating having the same impressed voltage as that for image recording was conducted by the whole illuminating section for 2 seconds since 7 seconds before the starting point of image recording until 5 seconds before it.

Experiment Number 1-2

With regard to each of image recording, preliminary illuminating having the same impressed voltage as that for image recording was conducted by the whole illuminating section for 10 seconds since 15 seconds before the starting point of image recording until 5 seconds before it.

Experiment Number 1-3

With regard to each of image recording, preliminary illuminating having the same impressed voltage as that for image recording was conducted by the whole illuminating section for 20 seconds since 25 seconds before the starting point of image recording until 5 seconds before it.

Experiment Number 1-4

With regard to each of image recording, preliminary illuminating having the same impressed voltage as that for image recording was conducted by the whole illuminating section for 60 seconds since 65 seconds before the starting point of image recording until 5 seconds before it.

Experiment Number 1-5

With regard to each of image recording, preliminary illuminating having the same impressed voltage as that for image recording was conducted by the whole illuminating section for 120 seconds since 125 seconds before the starting point of image recording until 5 seconds before it.

Experiment Number 1-6

With regard to each of image recording, preliminary illuminating, in which impressed voltage was increased by 10 V compared with the image recording was conducted by the whole illuminating section since 10 seconds before the starting point of image recording until 8 seconds before it.

Comparative Experiment Number 2-1

Preliminary illuminating was not conducted.

Experiment Results

| Experiment number | Results |
|---|---|
| 1-1 | A: Difference of density could not discriminated. |
| 1-2 | A: Difference of density could not discriminated. |
| 1-3 | B: Difference of density could scarcely discriminated. |
| 1-4: | B: Difference of density could scarcely discriminated. |
| 1-5: | C: The difference of density was almost invisible. Therefore, there is no practical problem. |
| 1-6: | A: Difference of density could not discriminated. |

-continued

| Experiment number | Results |
|---|---|
| 2-1: (comparison) | D: Difference of density is so prominent that the result can not be put into practical use. |

Experiment 2

An experiment was conducted in the same manner as in Experiment 1 except that the vacuum fluorescent print head on exposure head 51 was replaced with aged vacuum fluorescent print head. As a result, in all experiments of 1-1 through 1-6, improvement effects were observed. As is apparent from above, by emitting the head at a certain interval, stable outputting becomes possible. Using time of the machine can be reduced and workability can be increased without damaging the effects of the present invention, preferably when 60 seconds or less, more preferably when 20 seconds or less and more preferably when 10 seconds or less.

On every day, at a prescribed time, power supply for the image recording apparatus was actuated. A photographic image in which a face of a person was the main object and the background was a gradation from white to black was subjected to image recording for 10 sheets every day. The, the power supply was cut off. Aforesaid procedure was continued for 14 days. Prints taken on the first day and those on 14th day were compared. (1) the difference of color balance and density of prints taken on the first day and those on 14th day were compared. (2) the unevenness of color balance and density of prints taken on the first day and those on 14th day were compared, provided that the cathode voltage, the grid voltage and the anode voltage were turned OFF except when images were outputted.

Experiment 3-1

Each of image recording was subjected to preliminary illuminating under the same impressed voltage as the image recording by the whole illuminating section for 30 minutes at a period between the actuating the power supply and the starting point of image recording.

Experiment Number 3-2

An experiment was conducted in the same manner as in Experiment 3-1 except that the vacuum fluorescent print head on exposure heads 51 and 61 were replaced with aged vacuum fluorescent print head and that LED array on exposure head 41 was replaced with aged LED array.

Experiment 3-3

Each of image recording was subjected to preliminary illuminating under the same impressed voltage as the image recording by the whole illuminating section for 30 minutes at a period between the actuating the power supply and the starting point of image recording. Then, in order to obtain the correction data of illuminating strength between each of illuminating section on each exposure head, in each exposure head, pixels were lit in a prescribed order. Then, the resulting correction data were set.

Experiment 3-4

This experiment was conducted in the same manner as in Experiment 3-2 except that the time of the preliminary emission was set to be 10 minutes.

Experiment 3-5

This experiment was conducted in the same manner as in Experiment 3-4 except that the cathode voltage, the grid voltage and the anode voltage were turned ON.

Comparative Experiment Number 4-1

Image recording was conducted in which the preliminary illumination was conducted.

Experiment Results

| Experiment number | Evaluation (1) | Evaluation (2) |
|---|---|---|
| 3-1 | F | I |
| 3-2 | G | J |
| 3-3 | G | J |
| 3-4 | G | J |
| 3-5 | G | I |
| 4-1 (Comparative) | E | H |

Remarks

E: Apparently, there was a difference in terms of color balance or density.

F: Though there was a difference in terms of color balance or density, there is no practical problem.

G: Difference in terms of color balance or density could not be discriminated.

H: Apparently, there was unevenness in terms of density.

I: Though there was unevenness in terms of density, there is no practical problem.

J: Unevenness in terms of density could not be discriminated.

As is apparent from above, by conducting preliminary emission after power supply ON or at every prescribed time, stable image outputting becomes possible.

In addition, it is found that preliminary emission time is ordinarily 30 minutes or less and preferably 10 minutes or less from the viewpoint of stable outputting and mechanical workability.

By the use of a print head subjected to aging, the effects of the present invention is provided more effectively. In addition, by turning the cathode voltage, anode voltage and grid voltage OFF when the images are not outputted, the effects of the present invention is provided more effectively.

According to the present invention, the density fluctuation of the developed photosensitive material due to the light emission amount fluctuation of the light emitting sections of the recording head depending on its working history can be avoided.

What is claimed is:

1. An image recording apparatus for recording an image on a photosensitive material, comprising:

a vacuum fluorescent printing head having a vacuum tube in which electrodes and a plurality of light emitting phosphor elements provided for emitting light to the photosensitive material are incorporated, wherein when image recording is conducted based on image data, the electrodes are applied with electric voltages in accordance with the image data so as to emit electrons which collide onto surfaces of the light emitting phosphor elements so that the light emitting phosphor elements emit light, and wherein when image recording is not conducted, the surfaces of the light emitting phosphor elements are covered with gas remaining in the vacuum tube;

a shifting device for shifting the photosensitive material relatively to the vacuum fluorescent printing head so that an image is recorded on the photosensitive material with light emitted from the light emitting phosphor elements; and a controller for controlling the vacuum fluorescent printing head so that the vacuum fluorescent printing head conducts a preliminary light emission wherein all of said light emitting phosphor elements are illuminated by applying electric voltages based on preset emission data onto the electrodes before image recording based on image data so as to remove gas from the surfaces of the light emitting phosphor elements.

2. The apparatus of claim 1, wherein the controller controls the preliminary light emission to occur at predetermined times.

3. The apparatus of claim 2, wherein the controller controls the preliminary light emission to occur for not longer than 30 minutes.

4. The apparatus of claim 1, wherein the controller controls the preliminary light emission to occur for a predetermined time period.

5. The apparatus of claim 4, wherein the controller controls the preliminary light emission to occur for at least two seconds.

6. The apparatus of claim 4, wherein image recording is conducted for each processing order so as to print images of a film, and the controller controls the preliminary light emission to occur before the image recording for each processing order.

7. The apparatus of claim 6, wherein the controller controls the preliminary light emission to occur immediately before the image recording on the photosensitive material is started.

8. The apparatus of claim 4 wherein the controller controls the preliminary light emission to occur for not longer than 60 seconds for each printing order.

9. The apparatus of claim 1, wherein the controller controls the preliminary light emission to occur for not longer than 30 minutes.

10. The apparatus of claim 1, wherein the preset emission data is preset such that the controller controls the preliminary light emission from the light emitting phosphor elements to occur at an intensity which is greater than an intensity of light emitted from the light emitting phosphor elements based on the image data during image recording on the photosensitive material.

11. The apparatus of claim 1, wherein the controller controls the light emitting phosphor elements to respectively emit light for each pixel, and a light emitting time period of the preliminary light emission by the light emitting phosphor elements is longer than an average light emitting time period for one pixel during image recording on the photosensitive material.

12. The apparatus of claim 1, wherein the controller obtains light amount data for each of the light emitting phosphor elements during the preliminary light emission or after the preliminary light emission, and calculates correction data for an intensity of light emission among the light emitting phosphor elements based on the light amount data.

13. The apparatus of claim 1, wherein the vacuum fluorescent printing head is subject to an aging process in which the electrodes of the vacuum fluorescent printing head are applied with a predetermined electric voltage for a predetermined time period before the vacuum fluorescent printing head is used for image recording.

14. The apparatus of claim 1, wherein, when the vacuum fluorescent print head does not conduct image recording, at least one of a cathode voltage, a grid voltage and an anode voltage is turned off.

15. The apparatus of claim 1, wherein, when the vacuum fluorescent print head does not conduct image recording, all of a cathode voltage, a grid voltage and an anode voltage are turned off.

16. The apparatus of claim 1, wherein said controller controls the vacuum fluorescent printing head so that all of said light emitting phosphor elements are illuminated during said preliminary light emission.

17. The apparatus of claim 16, wherein said controller controls the vacuum fluorescent printing head so that said light emitting phosphor elements are illuminated separately during said preliminary light emission.

18. An image recording apparatus for recording image on a photosensitive material, comprising:

a vacuum fluorescent printing head having a vacuum tube in which electrodes and a plurality of light emitting phosphor elements provided for emitting light to the photosensitive material are incorporated, wherein when image recording is conducted based on image data, the electrodes are applied with electric voltages in accordance with the image data so as to emit electrons which collide onto surfaces of the light emitting phosphor elements so that the light emitting phosphor elements emit light, and wherein when image recording is not conducted, the surfaces of the light emitting phosphor elements are covered with gas remaining in the vacuum tube;

a shifting device for shifting the photosensitive material relatively to the vacuum fluorescent printing head so that an image is recorded on the photosensitive material with light emitted from the light emitting phosphor elements; and a controller for controlling the vacuum fluorescent printing head so that the vacuum fluorescent printing head conducts a preliminary light emission wherein all of said light emitting phosphor elements are illuminated by applying electric voltages based on preset emission data onto the electrodes for at least two seconds before image recording based on image data so as to remove gas from the surfaces of the light emitting phosphor elements.

19. The image recording apparatus of claim 18, wherein the controller controls the preliminary light emission to occur for not longer than 30 minutes.

* * * * *